US006404298B1

(12) United States Patent
Rohr et al.

(10) Patent No.: US 6,404,298 B1
(45) Date of Patent: Jun. 11, 2002

(54) ROTATABLE WAVEGUIDE TWIST

(75) Inventors: Stefan Rohr, Langenhagen; Daniel Wojtkowiak, Neustadt, both of (DE)

(73) Assignee: Alcatel, Paris (FR)

( * ) Notice: Subject to any disclaimer, the term of this patent is extended or adjusted under 35 U.S.C. 154(b) by 13 days.

(21) Appl. No.: 09/611,226

(22) Filed: Jul. 6, 2000

(30) Foreign Application Priority Data

Jul. 7, 1999 (DE) ..... 199 31 404

(51) Int. Cl.[7] ..... H01P 1/02
(52) U.S. Cl. ..... 333/21 A; 333/261; 333/208
(58) Field of Search ..... 333/21 A, 261, 333/208, 256

(56) References Cited

U.S. PATENT DOCUMENTS 3,024,463 A * 3/1962 Moeller et al. ..... 333/21 A
3,786,378 A * 1/1974 Liguori ..... 333/21 A

FOREIGN PATENT DOCUMENTS

DE 37 33 397 C1 3/1989 ..... 333/254

* cited by examiner

*Primary Examiner*—Justin P. Bettendorf
*Assistant Examiner*—Damian Cathey
(74) *Attorney, Agent, or Firm*—Sughrue Mion, PLLC

(57) ABSTRACT

In a waveguide twist having a torsion element with at least three individual parts situated adjacent to each other and rotatable around an axis of the torsion element, in which each of the individual parts has a central passage hole with a cross-section corresponding to the open cross-section of the waveguides, and in which the passage holes of the individual parts in a non-rotated condition of the torsion element are aligned with each other, a recess is formed in one face of each of the individual parts, the extent of the recess in circumferential direction corresponding to a specified angle of rotation; from the other face of the individual parts a pin extends in an axial direction; and in a mounted position of the torsion element a pin projecting from one individual part engages in the recess located in the face of the adjacent individual part.

3 Claims, 2 Drawing Sheets

ROTATABLE WAVEGUIDE TWIST

BACKGROUND OF THE INVENTION

This application is based on and claims the benefit of German Application 199 31 404.7, filed Jul. 7, 1999, which is incorporated herein by reference.

The invention concerns a waveguide twist for connecting electromagnetic waveguides, comprising a torsion element with at least three individual parts lying side by side with no gap, which can rotate around the axis of the torsion element, in which each of the individual parts has a central passage hole with a cross-section which corresponds to the hollow cross-section of the waveguides, and in which the passage holes of the individual parts are aligned in a non-rotated condition of the torsion element (DE-C-3 733 397).

Such a waveguide twist can be used for connecting rectangular or elliptical waveguides. For the sake of simplicity, the rectangular cross-section below is considered representative also for the elliptical cross-section. Such a waveguide twist is needed, e.g., if a waveguide must be connected to another waveguide or connected with a device with a waveguide connection, and if the axes of the respective connection points are in planes twisted in relation to each other. A possible application area is, e.g., in antennas with parabolic reflectors and a feeder line formed by a rectangular waveguide. In such an arrangement, a continuing waveguide is connected to the feed line to establish the connection to a transmission and reception plant. Between the feed line and the continuing waveguide, a device can be connected which, by way of example, contains mixers or other electronic components. The polarization plane, in which the transmission electromagnetic waves fluctuate, is fixed through the rectangular waveguide of the feed line, and is set for the antenna through corresponding rotation or arrangement of the feed line in the reflector. The connection end of the feed line is set so that its rectangular opening can assume various positions. This can lead to difficulties if the position of the continuing waveguide, and, in particular the position of a device to be connected in between, is fixed as a result of which the positions of the connection openings of these components are also fixed. In this case, for the particular application, transition components must be employed which facilitate conduction of waves between the feed line and the components which are to be connected to it with as little loss as possible.

The waveguide twist according to the aforementioned DE-C-3 733 397 is composed, by way of example, of three waveguide sections which are connected to each other so as to be capable of being rotated with respect to each other around their long axes. In this way, the waveguide twist can be set to various angles between the axes of the open cross-section (i.e., the internal part of the waveguide which acts as a "guide") at both of its ends. At the middle waveguide section, a lever is rotatably mounted externally which is oriented in a longitudinal direction of the waveguide twist. Projecting out at both ends of the lever are pegs which engage in channel grooves which are fabricated externally on the other two waveguide sections running in the longitudinal direction of the waveguide twist.

The construction of this known waveguide is expensive. With an increasing number of waveguide sections, it becomes increasingly complicated. The angle around which the waveguide sections can be rotated with respect to each other is limited by the fact that the pegs of the lever continue to engage in the channel grooves of the waveguide sections.

SUMMARY OF INVENTION

An object of the invention is to design more simply a waveguide twist of the type described above without limiting the angle of rotation.

This object is achieved according to the invention by a waveguide twist in which

- a recess is formed in one face of each individual part the extension of which in circumferential direction corresponds to a specified angle of rotation;
- pins oriented in an axial direction project from the other face of the individual parts, and
- in the mounted position of the torsion element, a pin projecting from an individual part engages in the recess situated in the face of the adjacent individual part.

This waveguide twist is simple in construction and is easy to use, and no parts visible from the outside are used. Its angle of rotation is limited only by length of the recesses formed in the individual parts in circumferential direction. It is composed of a suitable number of individual parts of which the one, upon being turned, carries the adjacent part with it through the pin which engages in the corresponding recess. Upon a rotation of an individual part situated at the end of the torsion element around a specified angle of rotation, all of the other individual parts are thus carried with it and are rotated by the proper angle. For a given rotational angle of the waveguide twist, the greater the number of individual parts employed, the smaller the angles are around which the individual parts must be rotated. The electrical losses elicited by the torsion element become increasingly small with an increasing number of individual parts. The reflection factor of the same then becomes more favorable. The torsion element is advantageous not only upon initial construction of a waveguide arrangement but also if, by way of example, a different polarization plane must be set in an already installed antenna arrangement.

BRIEF DESCRIPTION OF THE DRAWING

The invention will be more clearly understood from the following description in conjunction with the accompanying drawings, wherein.

DETAILED DESCRIPTION OF THE INVENTION

A torsion element for a waveguide twist according to the invention has at least three individual parts which are situated one next to the other without any gaps and which are rotatable around the axis of the torsion element. The two end parts can also be formed by the two waveguides which are to be joined. In this extreme case, only one additional individual part is arranged between the two waveguides. The individual parts all have a rectangular (or elliptical) central passage hole, the open width and dimensions of which are the same. The individual parts of the torsion element in a preferred embodiment are circular disks. They can then be held together and directed in an especially simple manner in a cylindrical housing the interior diameter of which corresponds to the external diameter of the disks. Any other useful structure of the torsion element is also conceivable with which all of the individual parts can be held together as a unit and which ensures the relative rotatability of the individual parts.

Figure 1:
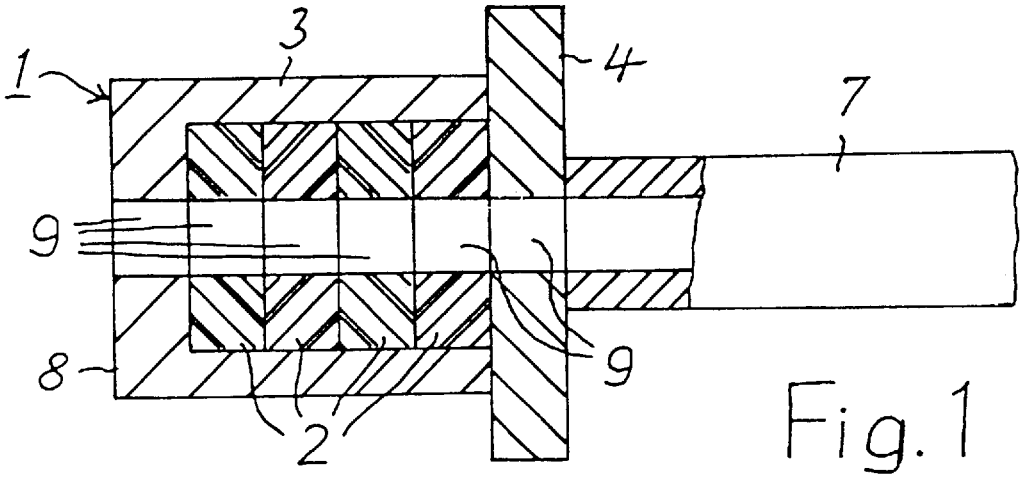
FIG. 1 is a sectional view of a torsion element for a waveguide twist according to the invention.
Figure 2:
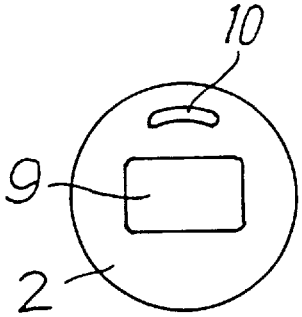
FIGS. 2 and 3 show two different views of an individual part of the torsion element according to FIG. 1.
Figure 3:
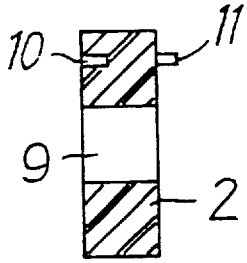
Figure 4:
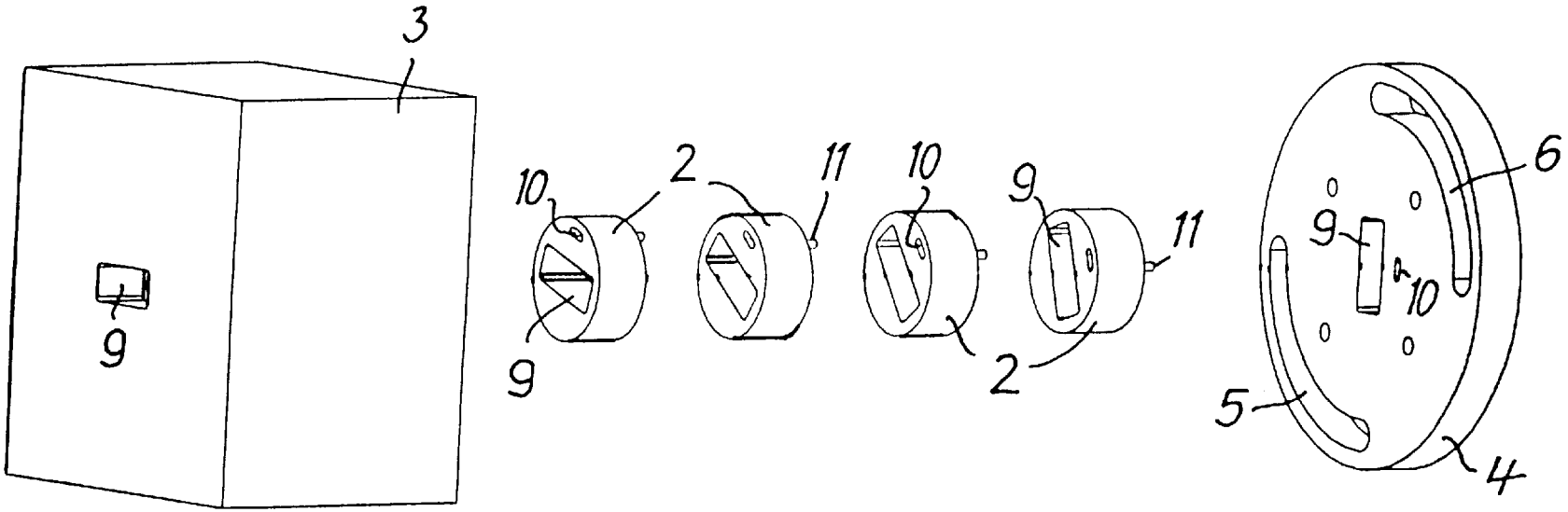
FIG. 4 shows the torsion element according to FIG. 1 in an exploded view.

According to the exemplary embodiment depicted in FIG. 1, a torsion element 1 for a waveguide twist comprises five individual parts. They are four circular disks 2, which are rotatably borne around a common axis in a cylindrical, pot-shaped housing 3 as the fifth individual part. The interior diameter of housing 3 corresponds to the exterior diameter of disks 2. Housing 3 can be installed in mounted position rotatably in a circumferential direction on a mounting plate 4, whereby it engages in slots 5 and 6 of mounting plate 4 (FIG. 4). Fastened to mounting plate 4 on the opposite side is a feed line 7 for an antenna, which by way of example, can be a waveguide with rectangular cross-section. All disks 2 and the bottom of housing 3 have a central, rectangular passage hole 9. In the un-twisted condition of torsion element 1, the passage holes 9 of all individual parts 2 and 8 are aligned with each other and with feed line 7 as can be seen in FIG. 1.

Each of disks 2 has on one face a recess, which in a preferred embodiment is configured as a slot 10 extending in a circumferential direction. The recess could also be configured to be circular or with a different cross-section. Only the length of its extension in the circumferential direction is important. The slot 10 is considered below as representative for all possible embodiments. At the other face of each of disks 2 a pin 11 projects in an axial direction. In the mounted position, pin 11 engages in a slot 10 of adjacent disk 2. The length of slots 10 limits the angle around which a disk 2 can rotate relative to an adjacent disk 2. In the depicted exemplary embodiment, the bottom 8 of housing 3 also has a pin 11 which engages in slot 10 of the same adjacent disk 2. Mounting plate 4 is likewise equipped with a slot 10 for receiving pin 11 of adjacent disk 2.

In a torsion element 1 with the depicted five individual parts, i.e., bottom 8 of housing 3 and four disks 2, slots 10 by way of example each have a length corresponding to an angle of 18°. Passage hole 9 in the bottom of housing 3 is then rotatable with respect to feed line 7 around an angle of rotation of 90°. If a different angle of rotation is to be realized, with the length of slots 10 held unchanged, the number of disks 2 must be changed, or with constant number of disks 2 the length of slots 10 must be changed.

Slots 10 can have the same length in circumferential direction in all disks 2 as is explained, with the angle of 18°. However, they can also be of differing length so that individual disks 2 are rotated differing distances. In the depicted exemplary embodiment with five disks 2 and a rotary angle of 90°, the angles corresponding to the particular length in circumferential direction of adjacent disks 2 could be graduated as follows: 12°–20°–24°–20°–12°. Such a design of a torsion element 1 can provide an even more favorable reflection factor.

Figure 5:
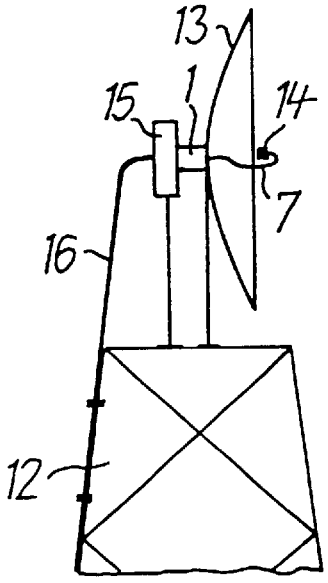
FIG. 5 shows a schematic depiction of an antenna arrangement with a torsion element.

In FIG. 5, the tip of a mast 12 is schematically shown on which a parabolic reflector 13 of an antenna is mounted. In reflector 13, the feed line 7 which is configured as a rectangular waveguide is fastened to the free end which is mounted to exciter 14 which serves to illuminate the antenna. On the side of reflector 13 away from feed line 7, a device 15 is mounted on mast 12 to which a waveguide 16 is connected which is joined to a transmission and receiving device (not shown). Between device 15 and feed line 7 is mounted a torsion element 1. The polarization plane of the antenna as a result of torsion element 1 can be changed through rotating feed line 7 without the position of device 15 or the waveguide 16 having to be changed.

What is claimed is:

1. A waveguide twist for connecting electromagnetic waveguides comprising:

a housing;

a torsion element provided in the housing, said torsion element including at least three individual parts situated adjacent to each other without any gaps and rotatable around an axis of the torsion element, in which each of the individual parts has a central passage hole with a cross-section corresponding to the opening cross-section of the waveguides, and in which the passage holes of the individual parts in a non-rotated condition of the torsion element are aligned with each other, wherein a recess is formed in one face of each of the individual parts, the extent of the recess in circumferential direction corresponding to a specified angle of rotation;

wherein from the other face of the individual parts a pin extends in an axial direction; and wherein in mounted position of the torsion element the pin, projecting from one individual part engages in the recess located in the face of the adjacent individual part.

2. A waveguide twist according to claim 1, wherein the recess formed in the face sides of the individual parts is configured as a slot (10).

3. A waveguide twist according to claim 1, wherein the individual parts of the torsion element are configured at least partially as circular disks which are mounted in the housing which is cylindrical, the interior diameter of the housing corresponding to the external diameter of the disks.

* * * * *